United States Patent [19]

Schmidt

[11] Patent Number: 4,798,153

[45] Date of Patent: Jan. 17, 1989

[54] STABILIZED HULL SWATH VEHICLE

[75] Inventor: Terrence W. Schmidt, Santa Clara, Calif.

[73] Assignee: Lockheed Missiles & Space Company, Inc., Sunnyvale, Calif.

[21] Appl. No.: 643,428

[22] Filed: Aug. 23, 1984

[51] Int. Cl.[4] ..... B63B 1/12

[52] U.S. Cl. ..... 114/61

[58] Field of Search ..... 114/61, 283, 256, 265

[56] References Cited

U.S. PATENT DOCUMENTS 1,731,493 10/1929 Harris ..... 114/283

2,534,812 12/1950 Curry ..... 114/283

FOREIGN PATENT DOCUMENTS 0076384 5/1983 Japan .

*Primary Examiner*—Sherman D. Basinger

*Attorney, Agent, or Firm*—H. Donald Volk

[57] ABSTRACT

The present invention is directed to a vessel that is hull stabilized. The stability is achieved by the particular orientation of the lower hulls. In one embodiment the lower hulls are inclined to the calm water or design waterline.

2 Claims, 2 Drawing Sheets

FIG_3
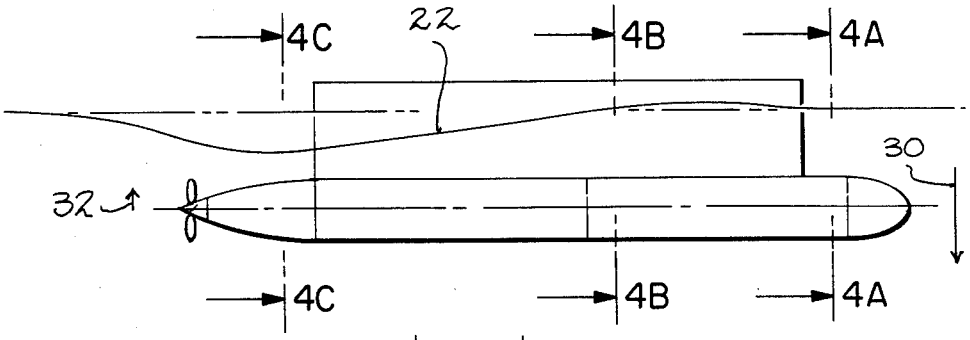
FIG_4C
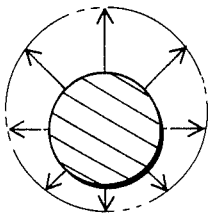
FIG_4A
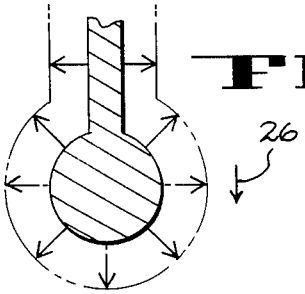
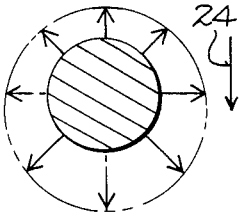
FIG_4B
FIG_5
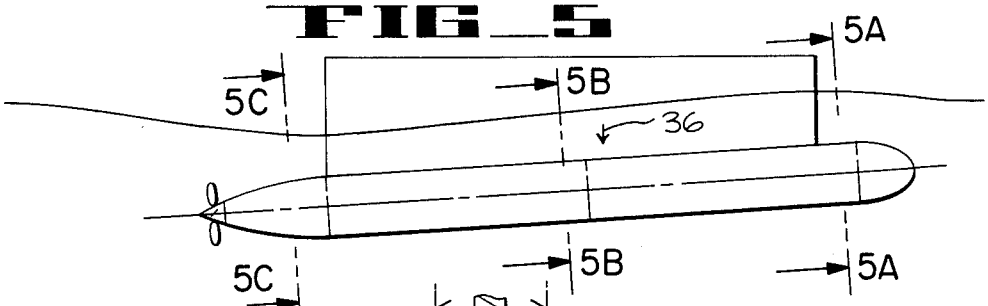
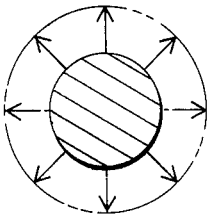
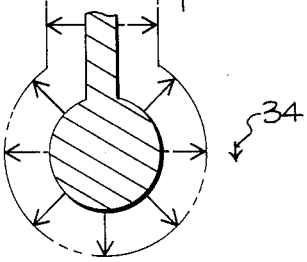
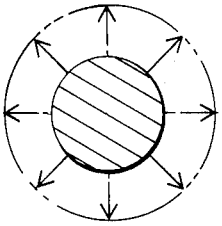
FIG_6C FIG_6A
FIG_6B

STABILIZED HULL SWATH VEHICLE

TECHNICAL FIELD

This invention relates to lower hull inclination for trim control, stability, and improved propulsion performance of small water plane twin hull design watercraft. More specifically, the configuration of the present invention incorporates lower hulls that are inclined relative to the design waterline of the vessel.

BACKGROUND ART

Semisubmerged or small water plane area twin hull ships, sometimes referred to as SWATH ships, have been developed for high-speed operation at high sea states. U.S. Pat. Nos. 3,623,444 and 3,897,744 issued to Thomas G. Lang, disclosed ships of this configuration which have better operational characteristics than conventional ships and can operate at much higher sea states.

The above noted patents point out a number of configurations for such vessels. All of the configurations noted in these patents include lower hulls that are parallel to the design water line. However, the movement of the swath vessel through the water, particularly at medium to high speed, causes the water surfaces to become depressed along the length of the hulls. This, in effect, causes the hulls to be misaligned with the flow so that the swath vessel is running in a bow-down condition. Such a trim condition decreases the ship's stability and increases the possibility of propeller broaching and ventilating.

To correct such a trim condition it is necessary to compensate with trim control surfaces or the like to balance the ship from its bow-down condition. This, in turn, requires the application of additional power to compensate for the drag caused by the trim control surfaces. Moreover, the trim of the vessel is inherently unstable and requires constant adjusting of the trim surfaces.

DISCLOSURE OF INVENTION

In accordance with the present invention, the vessel is stabilized by inclining the lower hulls bow up (stern down).

FIG. 3 is a simplified depiction of a hull of a conventional Swath vessel showing the water surface caused by the high speed operation of the vessel.

FIGS. 4A, 4B and 4C show, schematically, the hydrodynamic forces exerted on the hull of a conventional Swath vessel at sections A—A, B—B, and C—C, respectively, of FIG. 3.

FIG. 5 is a simplified depiction of a hull in accordance with the teachings of the water surface caused by the high speed operation of the vessel.

FIGS. 6A, 6B and 6C show, schematically, the hydrodynamic forces exerted on the hull of a vessel in accordance with the teachings of the present invention at sections A—A, B—B, C—C, respectively, of FIG. 5.

BEST METHOD OF CARRYING OUT THE INVENTION

Figures 1, 2:
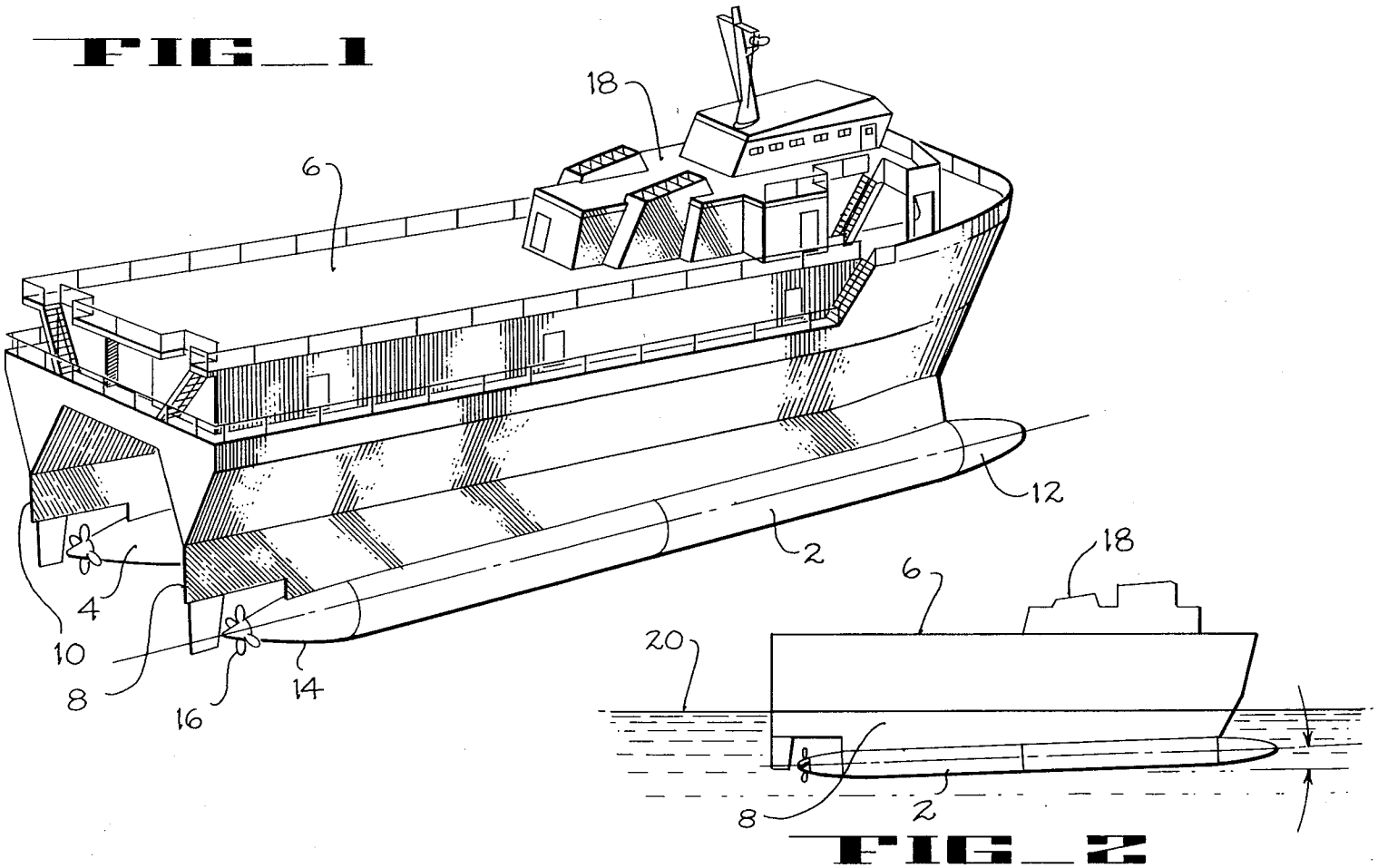
FIG. 1 is an isometric view of a vessel, of the present invention.
FIG. 2 is a profile view of the vessel of FIG. 1 illustrating the hull inclination.

One form of the invention is depicted in FIG. 1. A pair of essentially tubular shaped parallel submerged hulls 2 and 4 provide a buoyancy support for the upper hull 6 through a pair of struts 8, 10. Each of the submerged hulls 2 and 4 are made in the form of a long cylindrical shape, including a rounded bow 12 and a tapered stern 14.

Individual propellers 16 are mounted on the aft end of each of the submerged hulls 2 and 4. The propellers 16 are connected through a suitable transmission to a single power plant, or two individual power plants, to provide forward and reverse thrusts for movement of the vessel.

For illustration, the upper hull 6 is shown as a platform and includes a raised forward superstructure 18. Incorporated within the platform are the necessary ship machinery, storage holds, crew quarters, and the like.

The buoyant lower hulls 2 and 4 are inclined bow up relative to the calm water or design waterline. This would be best understood with the reference to FIG. 2. FIG. 2 is a profile view showing inclination of the lower hulls (2 and 4) to the design waterline 20.

An understanding of how the vessel is trim stabilized can be obtained by the referenced to FIG. 3, FIGS. 4A, 4B and 4C. As seen in FIG. 3, when a Swath vessel is operated at speed, a surface wave 22 is created. At high speed the movement of the vessel through the water causes a wave 22 (which is conventionally called the Kelvin Wake) to form aft of the bow that transitions into a trough towards the stern of the vessel. The forces exerted on the hull of the vessel due to the change of contour of the water surface can best be understood with reference to FIG. 4.

FIG. 4A shows the cross section of the hull taken along lines A—A of FIG. 3, which is a cross section of the hull forward of the strut. The hydrodynamic pressure force exerted on the hull at this point by the movement of the vessel through the water are shown by the arrows. The summation of all the pressure forces exerted on the hull at this point is shown by the net arrow 24, which is in a downward direction. This downward force is caused by a low pressure formed below the bow of the hull quite similar to the low pressure area formed on the leading edge of an air foil.

FIG. 4B is a simplified depliction of the pressure forces exerted on the hull of the Swath vessel amidship. The summation of all the forces exerted on the hull at this point is shown by the net arrow 26 which is in a downward direction.

FIG. 4C is a simplified depiction of the pressure forces exerted aft of the strut on a single hull of the Swath vessel by the movement of the vessel through the water. The pressure forces exerted are shown by the arrows and the summation of these pressure forces is illustrated by the net arrow 28 and is a force tending to lift the stern of the vessel.

As noted above, the movement of the vessel through the water causes a low pressure area to be formed below the bow and continuing along the hull to the stern where a low pressure area exists above the hull. It can be noted that the summation of the forces illustrated by the net arrows produces a resultant force and moment as shown by arrows 30 and 32 in the vertical direction. This resultant force, FIG. 3, which can be called the sinking force, is positioned forward on the hull causing the bow of the vessel to dive unless the force is counteracted by movable foils or canards. The use of foils or canards to trim the vessel causes trim drag which has the effect of reducing the maximum speed of the vessel or requiring additional power to drive the vessel or both.

Based on tests conducted on a sixty-four foot SWATH vessel, it is concluded that angle of inclination of the lower hulls should be between 1 degree and 5 degrees. The optimum angle of inclination will vary with the length and weight of the SWATH vessel, seaway response required, specific environmental conditions and operational requirements.

FIG. 5 shows a single submerged hull that is inclined to the calm water lines in accordance with the present invention.

FIG. 6A shows the cross section of the hull taken along lines A—A of FIG. 5, which is a cross section of the hull forward of the strut. The hydrodynamic pressure forces exerted on the hull at this point by the movement of the vessel through the water are shown by the arrows. The summation of all the pressure forces exerted on the hull at this point is substantially zero.

FIG. 6B shows the cross section of the hull taken along lines B—B of FIG. 5. The hydrodyanmic pressure forces exerted on the vessel at this point by the movement of the vessel through the water are shown by the arrows. The summation of all these forces is shown by the net arrow 34, which is in the downward direction.

Similarly, FIG. 6C shows the cross section of the hull taken along lines C—C of FIG. 5. The summation of the hydrodynamic pressure forces exerted on the hull at this point is substantially zero. It can be noted that the summation of the forces illustrated by the net arrow produces a resultant sinking force as shown by arrow 36, FIG. 5, and which is smaller than the sinking force shown in FIGS. 3 and 4 and does not produce a pitch moment.

It is understood that, the hulls could be inclined for SWATHS with struts having dihedral, camber, toe in or out and other arrangements. Other modification and advantageous applications of this invention will be apparent to those having ordinary skill in the art. Therefore, it is intended that the matter contained in the foregoing description and the accompanying drawings is illustrative and not limitative, the scope of the invention being defined by the appended claims.

I claim:

1. A hull stabilized, low water plane area, twin hull vessel having a design waterline, said vessel comprising: a plurality of substantially tubular shaped lower hulls for providing buoyancy support for said vessel, an upper hull, a plurality of struts, each strut connecting a lower hull to said upper hull, said struts mounting the said lower hull at an acute angle to said design waterline wherein the vertex of said acute angle is forward of said vessel.

2. The hull stabilized low water plane area twin hull vessel of claim 1 wherein the angle of inclination between said lower hull and said design waterline is between 1 degree and 5 degrees.

* * * * *